US011658404B2

(12) United States Patent
Compton

(10) Patent No.: US 11,658,404 B2
(45) Date of Patent: May 23, 2023

(54) ELECTRONIC DEVICES HAVING HOUSING-INTEGRATED DIELECTRIC RESONATOR ANTENNAS

(71) Applicant: Apple Inc., Cupertino, CA (US)

(72) Inventor: Lucas R. Compton, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 25 days.

(21) Appl. No.: 17/028,871

(22) Filed: Sep. 22, 2020

(65) Prior Publication Data

US 2022/0094046 A1 Mar. 24, 2022

(51) Int. Cl.

| | |
|---|---|
| ***H01Q 1/38*** | (2006.01) |
| ***H01Q 1/24*** | (2006.01) |
| ***H01Q 9/42*** | (2006.01) |
| ***H01Q 9/04*** | (2006.01) |

(52) U.S. Cl.

CPC ..... *H01Q 1/38* (2013.01); *H01Q 1/243* (2013.01); *H01Q 9/0485* (2013.01); *H01Q 9/42* (2013.01)

(58) Field of Classification Search

CPC ..... H01Q 9/42; H01Q 9/0485; H01Q 3/26; H01Q 1/38; H01Q 1/243

See application file for complete search history.

(56) References Cited

U.S. PATENT DOCUMENTS 4,124,830 A * 11/1978 Ren ..... H01P 7/10 333/209
6,087,912 A * 7/2000 Sakamoto ..... H01L 23/66 333/219.1
6,198,450 B1 * 3/2001 Adachi ..... H01Q 9/0485 343/873
8,803,745 B2 8/2014 Dabov
9,024,822 B2 5/2015 Tang
9,153,856 B2 10/2015 Rappoport et al.
9,876,272 B2 1/2018 Hu et al.
10,522,900 B2 12/2019 Khripkov et al.

(Continued)

FOREIGN PATENT DOCUMENTS

JP H0758505 A * 3/1995

OTHER PUBLICATIONS

U.S. Appl. No. 16/851,848, filed Apr. 17, 2020.

*Primary Examiner* — Graham P Smith
(74) *Attorney, Agent, or Firm* — Treyz Law Group, P.C.; Michael H. Lyons; Tianyi He

(57) ABSTRACT

An electronic device may be provided with a conductive sidewall and a phased antenna array having a dielectric resonator antenna aligned with an aperture in the conductive sidewall. A feed probe may excite the antenna to radiate through the aperture at a frequency greater than 10 GHz. The antenna may include an injection-molded plastic substrate that affixes the antenna to the peripheral conductive housing structures, thereby integrating the antenna into the conductive sidewall. A hole or other machining operation may be used to expose the feed probe through the injection-molded plastic substrate. Conductive interconnect structures may be inserted into the substrate and coupled to the feed probe. The interconnect structures may be soldered to a circuit board. The circuit board may be coupled to the feed probe through the interconnect structures. The circuit board may be mounted to a rear surface or a side surface of the injection-molded plastic substrate.

20 Claims, 8 Drawing Sheets

(56) References Cited

U.S. PATENT DOCUMENTS

| | | | | |
|---|---|---|---|---|
| 2018/0143145 | A1* | 5/2018 | Klein | G01N 22/00 |
| 2019/0123448 | A1* | 4/2019 | Taraschi | H01Q 9/0485 |
| 2020/0212581 | A1* | 7/2020 | Zhu | H01Q 9/0485 |
| 2020/0280133 | A1 | 9/2020 | Avser et al. | |
| 2022/0248986 | A1* | 8/2022 | Probst | A61B 5/1455 |

* cited by examiner

ELECTRONIC DEVICES HAVING HOUSING-INTEGRATED DIELECTRIC RESONATOR ANTENNAS

BACKGROUND

This relates generally to electronic devices and, more particularly, to electronic devices with wireless communications circuitry.

Electronic devices often include wireless communications circuitry. For example, cellular telephones, computers, and other devices often contain antennas and wireless transceivers for supporting wireless communications.

It may be desirable to support wireless communications in millimeter wave and centimeter wave communications bands. Millimeter wave communications, which are sometimes referred to as extremely high frequency (EHF) communications, and centimeter wave communications involve communications at frequencies of about 10-300 GHz. Operation at these frequencies can support high throughputs but may raise significant challenges. For example, radio-frequency signals at millimeter and centimeter wave frequencies can be characterized by substantial attenuation and/or distortion during signal propagation through various mediums. In addition, the presence of conductive electronic device components can make it difficult to incorporate circuitry for handling millimeter and centimeter wave communications into the electronic device.

It would therefore be desirable to be able to provide electronic devices with improved wireless communications circuitry such as communications circuitry that supports millimeter and centimeter wave communications.

SUMMARY

An electronic device may be provided with wireless circuitry and a housing. The housing may have peripheral conductive housing structures and a rear wall. A display may be mounted to the peripheral conductive housing structures opposite the rear wall. An aperture may be formed in the peripheral conductive housing structures. The wireless circuitry may include a phased antenna array. The phased antenna array may include a dielectric resonator antenna.

The dielectric resonator antenna may include a dielectric resonating element aligned with the aperture. A feed probe may be coupled to the dielectric resonating element. The feed probe may excite the dielectric resonating element to radiate through the aperture at a frequency greater than 10 GHz. The dielectric resonator antenna may include an injection-molded plastic substrate that affixes the dielectric resonating element to the peripheral conductive housing structures, thereby integrating the dielectric resonating element into the peripheral conductive housing structures. The feed probe and the dielectric resonating element may be embedded within the injection-molded plastic substrate. The injection-molded plastic substrate may include a first shot of injection-molded plastic over the feed probe and a second shot of injection-molded plastic over the first shot of injection-molded plastic and the dielectric resonating element.

A hole or other machining operation may be used to expose the feed probe through the injection-molded plastic substrate. Conductive interconnect structures such as a conductive pin may be inserted into the hole and coupled to the feed probe. The conductive interconnect structures may be soldered to a circuit board. The circuit board may be coupled to the feed probe through the conductive interconnect structures. The circuit board may be interposed between the dielectric resonating element and the display. In another suitable arrangement, the dielectric resonating element may be interposed between the circuit board and the aperture.

DETAILED DESCRIPTION

Figure 1:
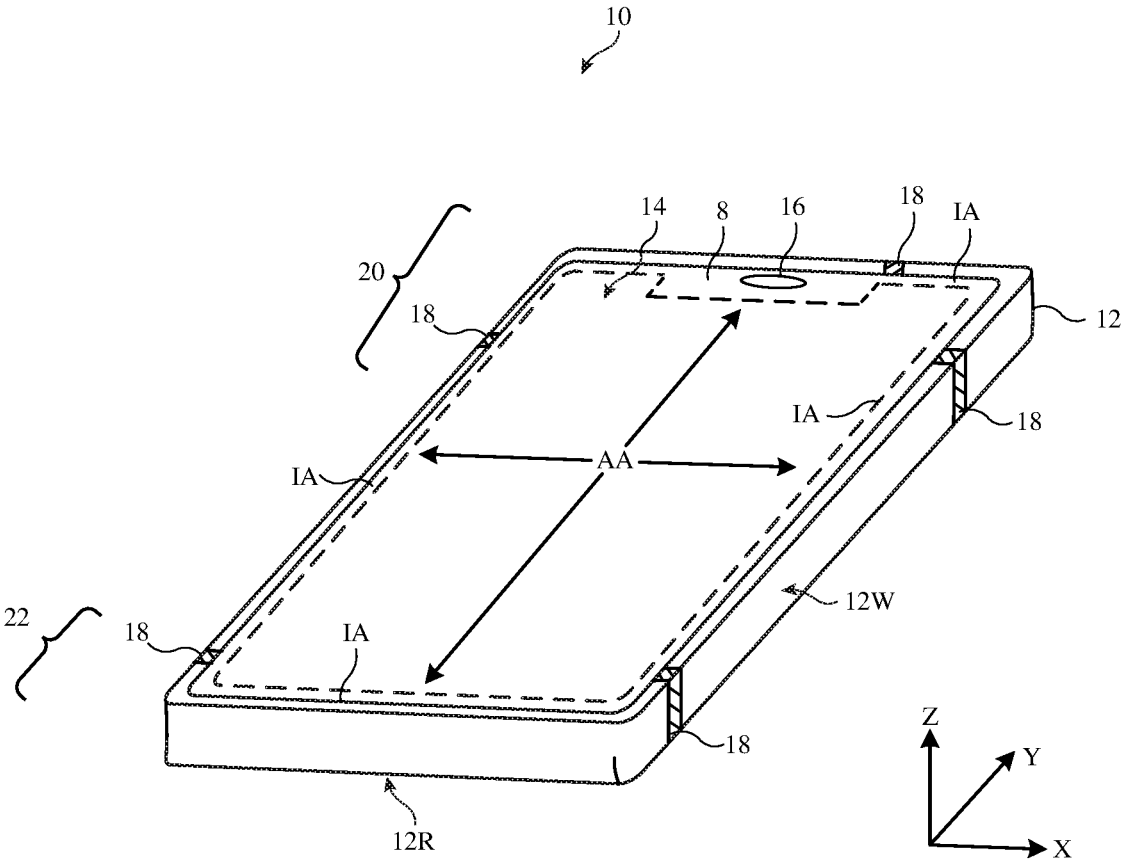
FIG. 1 is a perspective view of an illustrative electronic device in accordance with some embodiments.

An electronic device such as electronic device 10 of FIG. 1 may be provided with wireless circuitry that includes antennas. The antennas may be used to transmit and/or receive wireless radio-frequency signals. The antennas may include phased antenna arrays that are used for performing wireless communications and/or spatial ranging operations using millimeter and centimeter wave signals. Millimeter wave signals, which are sometimes referred to as extremely high frequency (EHF) signals, propagate at frequencies above about 30 GHz (e.g., at 60 GHz or other frequencies between about 30 GHz and 300 GHz). Centimeter wave signals propagate at frequencies between about 10 GHz and 30 GHz. If desired, device 10 may also contain antennas for handling satellite navigation system signals, cellular telephone signals, local wireless area network signals, near-field communications, light-based wireless communications, or other wireless communications.

Device 10 may be a portable electronic device or other suitable electronic device. For example, device 10 may be a laptop computer, a tablet computer, a somewhat smaller device such as a wrist-watch device, pendant device, headphone device, earpiece device, headset device, or other wearable or miniature device, a handheld device such as a cellular telephone, a media player, or other small portable device. Device 10 may also be a set-top box, a desktop computer, a display into which a computer or other processing circuitry has been integrated, a display without an integrated computer, a wireless access point, a wireless base station, an electronic device incorporated into a kiosk, building, or vehicle, or other suitable electronic equipment.

Device 10 may include a housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material (e.g., glass, ceramic, plastic, sapphire, etc.). In other situations, housing 12 or at least some of the structures that make up housing 12 may be formed from metal elements.

Device 10 may, if desired, have a display such as display 14. Display 14 may be mounted on the front face of device 10. Display 14 may be a touch screen that incorporates capacitive touch electrodes or may be insensitive to touch. The rear face of housing 12 (i.e., the face of device 10 opposing the front face of device 10) may have a substantially planar housing wall such as rear housing wall 12R (e.g., a planar housing wall). Rear housing wall 12R may have slots that pass entirely through the rear housing wall and that therefore separate portions of housing 12 from each other. Rear housing wall 12R may include conductive portions and/or dielectric portions. If desired, rear housing wall 12R may include a planar metal layer covered by a thin layer or coating of dielectric such as glass, plastic, sapphire, or ceramic (e.g., a dielectric cover layer). Housing 12 may also have shallow grooves that do not pass entirely through housing 12. The slots and grooves may be filled with plastic or other dielectric materials. If desired, portions of housing 12 that have been separated from each other (e.g., by a through slot) may be joined by internal conductive structures (e.g., sheet metal or other metal members that bridge the slot).

Housing 12 may include peripheral housing structures such as peripheral structures 12W. Conductive portions of peripheral structures 12W and conductive portions of rear housing wall 12R may sometimes be referred to herein collectively as conductive structures of housing 12. Peripheral structures 12W may run around the periphery of device 10 and display 14. In configurations in which device 10 and display 14 have a rectangular shape with four edges, peripheral structures 12W may be implemented using peripheral housing structures that have a rectangular ring shape with four corresponding edges and that extend from rear housing wall 12R to the front face of device 10 (as an example). In other words, device 10 may have a length (e.g., measured parallel to the Y-axis), a width that is less than the length (e.g., measured parallel to the X-axis), and a height (e.g., measured parallel to the Z-axis) that is less than the width. Peripheral structures 12W or part of peripheral structures 12W may serve as a bezel for display 14 (e.g., a cosmetic trim that surrounds all four sides of display 14 and/or that helps hold display 14 to device 10) if desired. Peripheral structures 12W may, if desired, form sidewall structures for device 10 (e.g., by forming a metal band with vertical sidewalls, curved sidewalls, etc.).

Peripheral structures 12W may be formed of a conductive material such as metal and may therefore sometimes be referred to as peripheral conductive housing structures, conductive housing structures, peripheral metal structures, peripheral conductive sidewalls, peripheral conductive sidewall structures, conductive housing sidewalls, peripheral conductive housing sidewalls, sidewalls, sidewall structures, or a peripheral conductive housing member (as examples). Peripheral conductive housing structures 12W may be formed from a metal such as stainless steel, aluminum, alloys, or other suitable materials. One, two, or more than two separate structures may be used in forming peripheral conductive housing structures 12W.

It is not necessary for peripheral conductive housing structures 12W to have a uniform cross-section. For example, the top portion of peripheral conductive housing structures 12W may, if desired, have an inwardly protruding ledge that helps hold display 14 in place. The bottom portion of peripheral conductive housing structures 12W may also have an enlarged lip (e.g., in the plane of the rear surface of device 10). Peripheral conductive housing structures 12W may have substantially straight vertical sidewalls, may have sidewalls that are curved, or may have other suitable shapes. In some configurations (e.g., when peripheral conductive housing structures 12W serve as a bezel for display 14), peripheral conductive housing structures 12W may run around the lip of housing 12 (i.e., peripheral conductive housing structures 12W may cover only the edge of housing 12 that surrounds display 14 and not the rest of the sidewalls of housing 12).

Rear housing wall 12R may lie in a plane that is parallel to display 14. In configurations for device 10 in which some or all of rear housing wall 12R is formed from metal, it may be desirable to form parts of peripheral conductive housing structures 12W as integral portions of the housing structures forming rear housing wall 12R. For example, rear housing wall 12R of device 10 may include a planar metal structure and portions of peripheral conductive housing structures 12W on the sides of housing 12 may be formed as flat or curved vertically extending integral metal portions of the planar metal structure (e.g., housing structures 12R and 12W may be formed from a continuous piece of metal in a unibody configuration). Housing structures such as these may, if desired, be machined from a block of metal and/or may include multiple metal pieces that are assembled together to form housing 12. Rear housing wall 12R may have one or more, two or more, or three or more portions. Peripheral conductive housing structures 12W and/or conductive portions of rear housing wall 12R may form one or more exterior surfaces of device 10 (e.g., surfaces that are visible to a user of device 10) and/or may be implemented using internal structures that do not form exterior surfaces of device 10 (e.g., conductive housing structures that are not visible to a user of device 10 such as conductive structures that are covered with layers such as thin cosmetic layers, protective coatings, and/or other coating/cover layers that may include dielectric materials such as glass, ceramic, plastic, or other structures that form the exterior surfaces of device 10 and/or serve to hide peripheral conductive housing structures 12W and/or conductive portions of rear housing wall 12R from view of the user).

Display 14 may have an array of pixels that form an active area AA that displays images for a user of device 10. For example, active area AA may include an array of display pixels. The array of pixels may be formed from liquid crystal display (LCD) components, an array of electrophoretic pixels, an array of plasma display pixels, an array of organic light-emitting diode display pixels or other light-emitting diode pixels, an array of electrowetting display pixels, or display pixels based on other display technologies. If desired, active area AA may include touch sensors such as touch sensor capacitive electrodes, force sensors, or other sensors for gathering a user input.

Display 14 may have an inactive border region that runs along one or more of the edges of active area AA. Inactive area IA of display 14 may be free of pixels for displaying images and may overlap circuitry and other internal device structures in housing 12. To block these structures from view by a user of device 10, the underside of the display cover layer or other layers in display 14 that overlap inactive area IA may be coated with an opaque masking layer in inactive area IA. The opaque masking layer may have any suitable color. Inactive area IA may include a recessed region or notch that extends into active area AA (e.g., at speaker port 16). Active area AA may, for example, be defined by the lateral area of a display module for display 14 (e.g., a display module that includes pixel circuitry, touch sensor circuitry, etc.).

Display 14 may be protected using a display cover layer such as a layer of transparent glass, clear plastic, transparent ceramic, sapphire, or other transparent crystalline material, or other transparent layer(s). The display cover layer may have a planar shape, a convex curved profile, a shape with planar and curved portions, a layout that includes a planar main area surrounded on one or more edges with a portion that is bent out of the plane of the planar main area, or other suitable shapes. The display cover layer may cover the entire front face of device 10. In another suitable arrangement, the display cover layer may cover substantially all of the front face of device 10 or only a portion of the front face of device 10. Openings may be formed in the display cover layer. For example, an opening may be formed in the display cover layer to accommodate a button. An opening may also be formed in the display cover layer to accommodate ports such as speaker port 16 or a microphone port. Openings may be formed in housing 12 to form communications ports (e.g., an audio jack port, a digital data port, etc.) and/or audio ports for audio components such as a speaker and/or a microphone if desired.

Display 14 may include conductive structures such as an array of capacitive electrodes for a touch sensor, conductive lines for addressing pixels, driver circuits, etc. Housing 12 may include internal conductive structures such as metal frame members and a planar conductive housing member (sometimes referred to as a conductive support plate or backplate) that spans the walls of housing 12 (e.g., a substantially rectangular sheet formed from one or more metal parts that is welded or otherwise connected between opposing sides of peripheral conductive housing structures 12W). The conductive support plate may form an exterior rear surface of device 10 or may be covered by a dielectric cover layer such as a thin cosmetic layer, protective coating, and/or other coatings that may include dielectric materials such as glass, ceramic, plastic, or other structures that form the exterior surfaces of device 10 and/or serve to hide the conductive support plate from view of the user (e.g., the conductive support plate may form part of rear housing wall 12R). Device 10 may also include conductive structures such as printed circuit boards, components mounted on printed circuit boards, and other internal conductive structures. These conductive structures, which may be used in forming a ground plane in device 10, may extend under active area AA of display 14, for example.

In regions 22 and 20, openings may be formed within the conductive structures of device 10 (e.g., between peripheral conductive housing structures 12W and opposing conductive ground structures such as conductive portions of rear housing wall 12R, conductive traces on a printed circuit board, conductive electrical components in display 14, etc.). These openings, which may sometimes be referred to as gaps, may be filled with air, plastic, and/or other dielectrics and may be used in forming slot antenna resonating elements for one or more antennas in device 10, if desired.

Conductive housing structures and other conductive structures in device 10 may serve as a ground plane for the antennas in device 10. The openings in regions 22 and 20 may serve as slots in open or closed slot antennas, may serve as a central dielectric region that is surrounded by a conductive path of materials in a loop antenna, may serve as a space that separates an antenna resonating element such as a strip antenna resonating element or an inverted-F antenna resonating element from the ground plane, may contribute to the performance of a parasitic antenna resonating element, or may otherwise serve as part of antenna structures formed in regions 22 and 20. If desired, the ground plane that is under active area AA of display 14 and/or other metal structures in device 10 may have portions that extend into parts of the ends of device 10 (e.g., the ground may extend towards the dielectric-filled openings in regions 22 and 20), thereby narrowing the slots in regions 22 and 20. Region 22 may sometimes be referred to herein as lower region 22 or lower end 22 of device 10. Region 20 may sometimes be referred to herein as upper region 20 or upper end 20 of device 10.

In general, device 10 may include any suitable number of antennas (e.g., one or more, two or more, three or more, four or more, etc.). The antennas in device 10 may be located at opposing first and second ends of an elongated device housing (e.g., at lower region 22 and/or upper region 20 of device 10 of FIG. 1), along one or more edges of a device housing, in the center of a device housing, in other suitable locations, or in one or more of these locations. The arrangement of FIG. 1 is merely illustrative.

Portions of peripheral conductive housing structures 12W may be provided with peripheral gap structures. For example, peripheral conductive housing structures 12W may be provided with one or more dielectric-filled gaps such as gaps 18, as shown in FIG. 1. The gaps in peripheral conductive housing structures 12W may be filled with dielectric such as polymer, ceramic, glass, air, other dielectric materials, or combinations of these materials. Gaps 18 may divide peripheral conductive housing structures 12W into one or more peripheral conductive segments. The conductive segments that are formed in this way may form parts of antennas in device 10 if desired. Other dielectric openings may be formed in peripheral conductive housing structures 12W (e.g., dielectric openings other than gaps 18) and may serve as dielectric antenna windows for antennas mounted within the interior of device 10. Antennas within device 10 may be aligned with the dielectric antenna windows for conveying radio-frequency signals through peripheral conductive housing structures 12W. Antennas within device 10 may also be aligned with inactive area IA of display 14 for conveying radio-frequency signals through display 14.

In order to provide an end user of device 10 with as large of a display as possible (e.g., to maximize an area of the device used for displaying media, running applications, etc.), it may be desirable to increase the amount of area at the front face of device 10 that is covered by active area AA of display 14. Increasing the size of active area AA may reduce the size of inactive area IA within device 10. This may reduce the area behind display 14 that is available for antennas within device 10. For example, active area AA of display 14 may include conductive structures that serve to block radio-frequency signals handled by antennas mounted behind active area AA from radiating through the front face of device 10. It would therefore be desirable to be able to provide antennas that occupy a small amount of space within device 10 (e.g., to allow for as large of a display active area AA as possible) while still allowing the antennas to communicate with wireless equipment external to device 10 with satisfactory efficiency bandwidth.

In a typical scenario, device 10 may have one or more upper antennas and one or more lower antennas. An upper antenna may, for example, be formed in upper region 20 of device 10. A lower antenna may, for example, be formed in lower region 22 of device 10. Additional antennas may be formed along the edges of housing 12 extending between regions 20 and 22 if desired. An example in which device 10 includes three or four upper antennas and five lower antennas is described herein as an example. The antennas may be used separately to cover identical communications bands, overlapping communications bands, or separate communications bands. The antennas may be used to implement an antenna diversity scheme or a multiple-input-multiple-output (MIMO) antenna scheme. Other antennas for covering any other desired frequencies may also be mounted at any desired locations within the interior of device 10. The example of FIG. 1 is merely illustrative. If desired, housing 12 may have other shapes (e.g., a square shape, cylindrical shape, spherical shape, combinations of these and/or different shapes, etc.).

Figure 2:
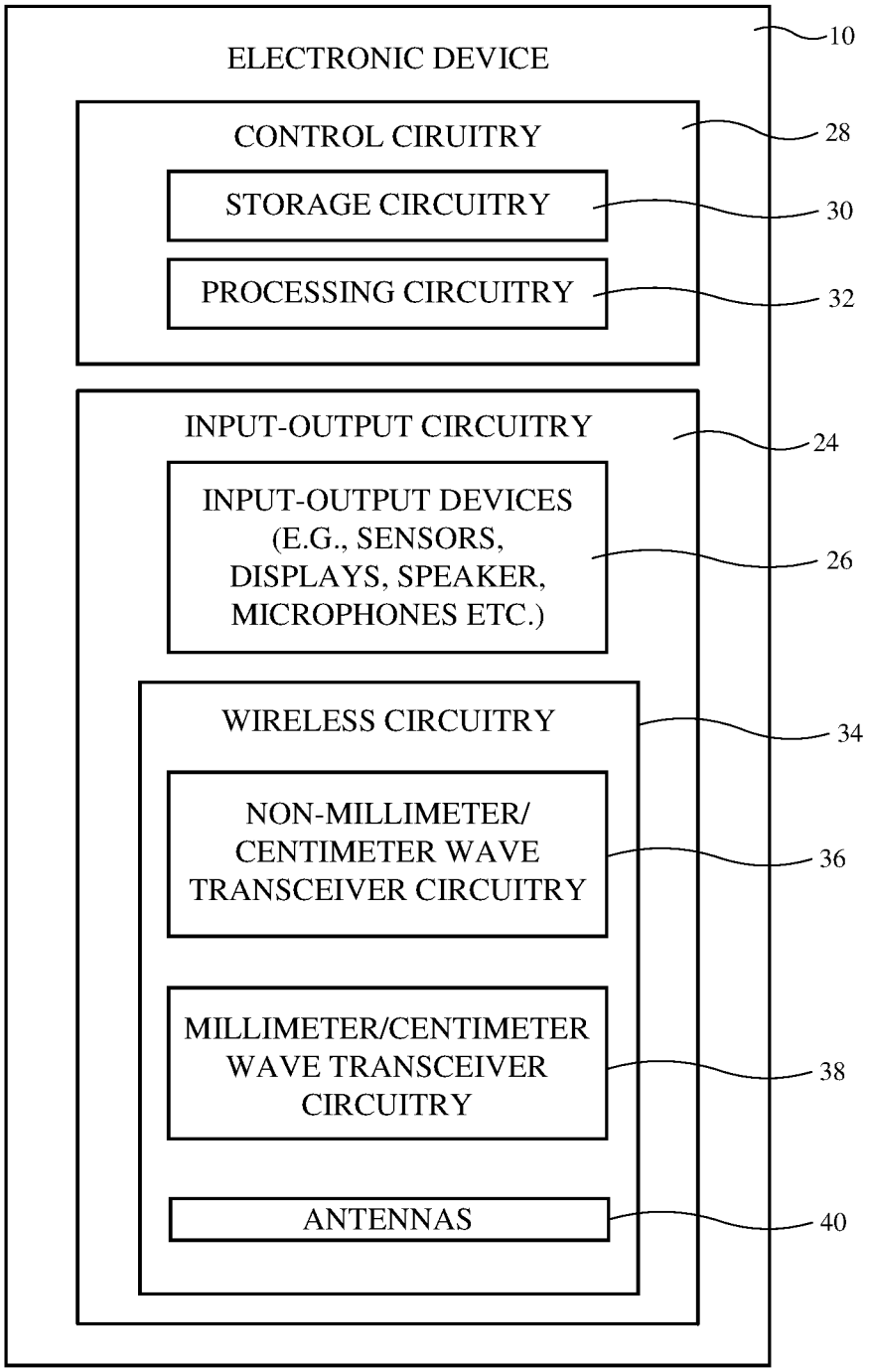
FIG. 2 is a schematic diagram of illustrative circuitry in an electronic device in accordance with some embodiments.

A schematic diagram of illustrative components that may be used in device 10 is shown in FIG. 2. As shown in FIG. 2, device 10 may include control circuitry 28. Control circuitry 28 may include storage such as storage circuitry 30. Storage circuitry 30 may include hard disk drive storage, nonvolatile memory (e.g., flash memory or other electrically-programmable-read-only memory configured to form a solid-state drive), volatile memory (e.g., static or dynamic random-access-memory), etc.

Control circuitry 28 may include processing circuitry such as processing circuitry 32. Processing circuitry 32 may be used to control the operation of device 10. Processing circuitry 32 may include on one or more microprocessors, microcontrollers, digital signal processors, host processors, baseband processor integrated circuits, application specific integrated circuits, central processing units (CPUs), etc. Control circuitry 28 may be configured to perform operations in device 10 using hardware (e.g., dedicated hardware or circuitry), firmware, and/or software. Software code for performing operations in device 10 may be stored on storage circuitry 30 (e.g., storage circuitry 30 may include non-transitory (tangible) computer readable storage media that stores the software code). The software code may sometimes be referred to as program instructions, software, data, instructions, or code. Software code stored on storage circuitry 30 may be executed by processing circuitry 32.

Control circuitry 28 may be used to run software on device 10 such as internet browsing applications, voice-over-internet-protocol (VOIP) telephone call applications, email applications, media playback applications, operating system functions, etc. To support interactions with external equipment, control circuitry 28 may be used in implementing communications protocols. Communications protocols that may be implemented using control circuitry 28 include internet protocols, wireless local area network protocols (e.g., IEEE 802.11 protocols—sometimes referred to as WiFi®), protocols for other short-range wireless communications links such as the Bluetooth® protocol or other WPAN protocols, IEEE 802.11ad protocols, cellular telephone protocols, MIMO protocols, antenna diversity protocols, satellite navigation system protocols, antenna-based spatial ranging protocols (e.g., radio detection and ranging (RADAR) protocols or other desired range detection protocols for signals conveyed at millimeter and centimeter wave frequencies), etc. Each communication protocol may be associated with a corresponding radio access technology (RAT) that specifies the physical connection methodology used in implementing the protocol.

Device 10 may include input-output circuitry 24. Input-output circuitry 24 may include input-output devices 26. Input-output devices 26 may be used to allow data to be supplied to device 10 and to allow data to be provided from device 10 to external devices. Input-output devices 26 may include user interface devices, data port devices, sensors, and other input-output components. For example, input-output devices may include touch screens, displays without touch sensor capabilities, buttons, joysticks, scrolling wheels, touch pads, key pads, keyboards, microphones, cameras, speakers, status indicators, light sources, audio jacks and other audio port components, digital data port devices, light sensors, gyroscopes, accelerometers or other components that can detect motion and device orientation relative to the Earth, capacitance sensors, proximity sensors (e.g., a capacitive proximity sensor and/or an infrared proximity sensor), magnetic sensors, and other sensors and input-output components.

Input-output circuitry 24 may include wireless circuitry such as wireless circuitry 34 for wirelessly conveying radio-frequency signals. While control circuitry 28 is shown separately from wireless circuitry 34 in the example of FIG. 2 for the sake of clarity, wireless circuitry 34 may include processing circuitry that forms a part of processing circuitry 32 and/or storage circuitry that forms a part of storage circuitry 30 of control circuitry 28 (e.g., portions of control circuitry 28 may be implemented on wireless circuitry 34). As an example, control circuitry 28 may include baseband processor circuitry or other control components that form a part of wireless circuitry 34.

Wireless circuitry 34 may include millimeter and centimeter wave transceiver circuitry such as millimeter/centimeter wave transceiver circuitry 38. Millimeter/centimeter wave transceiver circuitry 38 may support communications at frequencies between about 10 GHz and 300 GHz. For example, millimeter/centimeter wave transceiver circuitry 38 may support communications in Extremely High Frequency (EHF) or millimeter wave communications bands between about 30 GHz and 300 GHz and/or in centimeter wave communications bands between about 10 GHz and 30 GHz (sometimes referred to as Super High Frequency (SHF) bands). As examples, millimeter/centimeter wave transceiver circuitry 38 may support communications in an IEEE K communications band between about 18 GHz and 27 GHz, a $K_a$ communications band between about 26.5 GHz and 40 GHz, a $K_u$ communications band between about 12 GHz and 18 GHz, a V communications band between about 40 GHz and 75 GHz, a W communications band between about 75 GHz and 110 GHz, or any other desired frequency band between approximately 10 GHz and 300 GHz. If desired, millimeter/centimeter wave transceiver circuitry 38 may support IEEE 802.11ad communications at 60 GHz (e.g., WiGig or 60 GHz Wi-Fi bands around 57-61 GHz), and/or $5^{th}$ generation mobile networks or $5^{th}$ generation wireless systems (5G) New Radio (NR) Frequency Range 2 (FR2) communications bands between about 24 GHz and 90 GHz. Millimeter/centimeter wave transceiver circuitry 38 may be formed from one or more integrated circuits (e.g., multiple integrated circuits mounted on a common printed circuit in a system-in-package device, one or more integrated circuits mounted on different substrates, etc.).

Millimeter/centimeter wave transceiver circuitry 38 (sometimes referred to herein simply as transceiver circuitry 38 or millimeter/centimeter wave circuitry 38) may perform spatial ranging operations using radio-frequency signals at millimeter and/or centimeter wave frequencies that are transmitted and received by millimeter/centimeter wave transceiver circuitry 38. The received signals may be a version of the transmitted signals that have been reflected off of external objects and back towards device 10. Control circuitry 28 may process the transmitted and received signals to detect or estimate a range between device 10 and one or more external objects in the surroundings of device 10 (e.g., objects external to device 10 such as the body of a user or other persons, other devices, animals, furniture, walls, or other objects or obstacles in the vicinity of device 10). If desired, control circuitry 28 may also process the transmitted and received signals to identify a two or three-dimensional spatial location of the external objects relative to device 10.

Spatial ranging operations performed by millimeter/centimeter wave transceiver circuitry 38 are unidirectional. If desired, millimeter/centimeter wave transceiver circuitry 38 may also perform bidirectional communications with external wireless equipment such as external wireless equipment 10 (e.g., over a bi-directional millimeter/centimeter wave wireless communications link). The external wireless equipment may include other electronic devices such as electronic device 10, a wireless base station, wireless access point, a wireless accessory, or any other desired equipment that transmits and receives millimeter/centimeter wave signals. Bidirectional communications involve both the transmission of wireless data by millimeter/centimeter wave transceiver circuitry 38 and the reception of wireless data that has been transmitted by external wireless equipment. The wireless data may, for example, include data that has been encoded into corresponding data packets such as wireless data associated with a telephone call, streaming media content, internet browsing, wireless data associated with software applications running on device 10, email messages, etc.

If desired, wireless circuitry 34 may include transceiver circuitry for handling communications at frequencies below 10 GHz such as non-millimeter/centimeter wave transceiver circuitry 36. For example, non-millimeter/centimeter wave transceiver circuitry 36 may handle wireless local area network (WLAN) communications bands such as the 2.4 GHz and 5 GHz Wi-Fi® (IEEE 802.11) bands, wireless personal area network (WPAN) communications bands such as the 2.4 GHz Bluetooth® communications band, cellular telephone communications bands such as a cellular low band (LB) (e.g., 600 to 960 MHz), a cellular low-midband (LMB) (e.g., 1400 to 1550 MHz), a cellular midband (MB) (e.g., from 1700 to 2200 MHz), a cellular high band (HB) (e.g., from 2300 to 2700 MHz), a cellular ultra-high band (UHB) (e.g., from 3300 to 5000 MHz, or other cellular communications bands between about 600 MHz and about 5000 MHz (e.g., 3G bands, 4G LTE bands, 5G New Radio Frequency Range 1 (FR1) bands below 10 GHz, etc.), a near-field communications (NFC) band (e.g., at 13.56 MHz), satellite navigations bands (e.g., an L1 global positioning system (GPS) band at 1575 MHz, an L5 GPS band at 1176 MHz, a Global Navigation Satellite System (GLONASS) band, a BeiDou Navigation Satellite System (BDS) band, etc.), ultra-wideband (UWB) communications band(s) supported by the IEEE 802.15.4 protocol and/or other UWB communications protocols (e.g., a first UWB communications band at 6.5 GHz and/or a second UWB communications band at 8.0 GHz), and/or any other desired communications bands. The communications bands handled by the radio-frequency transceiver circuitry may sometimes be referred to herein as frequency bands or simply as "bands," and may span corresponding ranges of frequencies. Non-millimeter/centimeter wave transceiver circuitry 36 and millimeter/centimeter wave transceiver circuitry 38 may each include one or more integrated circuits, power amplifier circuitry, low-noise input amplifiers, passive radio-frequency components, switching circuitry, transmission line structures, and other circuitry for handling radio-frequency signals.

In general, the transceiver circuitry in wireless circuitry 34 may cover (handle) any desired frequency bands of interest. As shown in FIG. 2, wireless circuitry 34 may include antennas 40. The transceiver circuitry may convey radio-frequency signals using one or more antennas 40 (e.g., antennas 40 may convey the radio-frequency signals for the transceiver circuitry). The term "convey radio-frequency signals" as used herein means the transmission and/or reception of the radio-frequency signals (e.g., for performing unidirectional and/or bidirectional wireless communications with external wireless communications equipment). Antennas 40 may transmit the radio-frequency signals by radiating the radio-frequency signals into free space (or to freespace through intervening device structures such as a dielectric cover layer). Antennas 40 may additionally or alternatively receive the radio-frequency signals from free space (e.g., through intervening devices structures such as a dielectric cover layer). The transmission and reception of radio-frequency signals by antennas 40 each involve the excitation or resonance of antenna currents on an antenna resonating element in the antenna by the radio-frequency signals within the frequency band(s) of operation of the antenna.

In satellite navigation system links, cellular telephone links, and other long-range links, radio-frequency signals are typically used to convey data over thousands of feet or miles. In Wi-Fi® and Bluetooth® links at 2.4 and 5 GHz and other short-range wireless links, radio-frequency signals are typically used to convey data over tens or hundreds of feet. Millimeter/centimeter wave transceiver circuitry 38 may convey radio-frequency signals over short distances that travel over a line-of-sight path. To enhance signal reception for millimeter and centimeter wave communications, phased antenna arrays and beam forming (steering) techniques may be used (e.g., schemes in which antenna signal phase and/or magnitude for each antenna in an array are adjusted to perform beam steering). Antenna diversity schemes may also be used to ensure that the antennas that have become blocked or that are otherwise degraded due to the operating environment of device 10 can be switched out of use and higher-performing antennas used in their place.

Antennas 40 in wireless circuitry 34 may be formed using any suitable antenna types. For example, antennas 40 may include antennas with resonating elements that are formed from stacked patch antenna structures, loop antenna structures, patch antenna structures, inverted-F antenna structures, slot antenna structures, planar inverted-F antenna structures, monopole antenna structures, dipole antenna structures, helical antenna structures, Yagi (Yagi-Uda) antenna structures, hybrids of these designs, etc. In another suitable arrangement, antennas 40 may include antennas with dielectric resonating elements such as dielectric resonator antennas. If desired, one or more of antennas 40 may be cavity-backed antennas. Different types of antennas may be used for different bands and combinations of bands. For example, one type of antenna may be used in forming a non-millimeter/centimeter wave wireless link for non-millimeter/centimeter wave transceiver circuitry 36 and another type of antenna may be used in conveying radio-frequency signals at millimeter and/or centimeter wave frequencies for millimeter/centimeter wave transceiver circuitry 38. Antennas 40 that are used to convey radio-frequency signals at millimeter and centimeter wave frequencies may be arranged in one or more phased antenna arrays.

Figure 3:
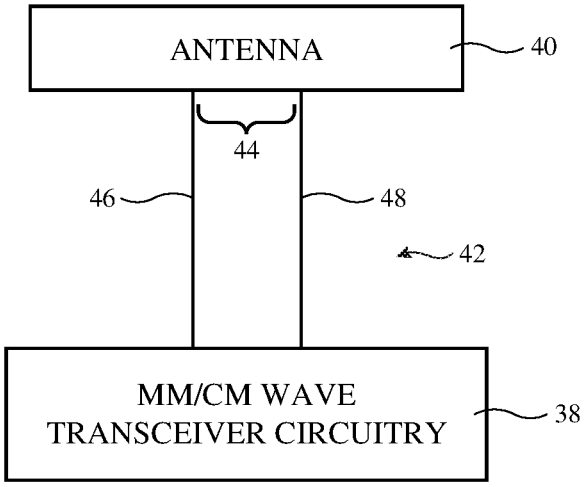
FIG. 3 is a schematic diagram of illustrative wireless circuitry in accordance with some embodiments.

A schematic diagram of an antenna 40 that may be formed in a phased antenna array for conveying radio-frequency signals at millimeter and centimeter wave frequencies is shown in FIG. 3. As shown in FIG. 3, antenna 40 may be coupled to millimeter/centimeter (MM/CM) wave transceiver circuitry 38. Millimeter/centimeter wave transceiver circuitry 38 may be coupled to antenna feed 44 of antenna 40 using a transmission line path that includes radio-frequency transmission line 42. Radio-frequency transmission line 42 may include a positive signal conductor such as signal conductor 46 and may include a ground conductor such as ground conductor 48. Ground conductor 48 may be coupled to the antenna ground for antenna 40 (e.g., over a ground antenna feed terminal of antenna feed 44 located at the antenna ground). Signal conductor 46 may be coupled to the antenna resonating element for antenna 40. For example, signal conductor 46 may be coupled to a positive antenna feed terminal of antenna feed 44 located at the antenna resonating element.

In another suitable arrangement, antenna 40 may be a probe-fed antenna that is fed using a feed probe. In this arrangement, antenna feed 44 may be implemented as a feed probe. Signal conductor 46 may be coupled to the feed probe. Radio-frequency transmission line 42 may convey radio-frequency signals to and from the feed probe. When radio-frequency signals are being transmitted over the feed probe and the antenna, the feed probe may excite the resonating element for the antenna (e.g., may excite electromagnetic resonant modes of a dielectric antenna resonating element for antenna 40). The resonating element may radiate the radio-frequency signals in response to excitation by the feed probe. Similarly, when radio-frequency signals are received by the antenna (e.g., from free space), the radio-frequency signals may excite the resonating element for the antenna (e.g., may excite electromagnetic resonant modes of the dielectric antenna resonating element for antenna 40). This may produce antenna currents on the feed probe and the corresponding radio-frequency signals may be passed to the transceiver circuitry over the radio-frequency transmission line.

Radio-frequency transmission line 42 may include a stripline transmission line (sometimes referred to herein simply as a stripline), a coaxial cable, a coaxial probe realized by metalized vias, a microstrip transmission line, an edge-coupled microstrip transmission line, an edge-coupled stripline transmission lines, a waveguide structure, combinations of these, etc. Multiple types of transmission lines may be used to form the transmission line path that couples millimeter/centimeter wave transceiver circuitry 38 to antenna feed 44. Filter circuitry, switching circuitry, impedance matching circuitry, phase shifter circuitry, amplifier circuitry, and/or other circuitry may be interposed on radio-frequency transmission line 42, if desired.

Radio-frequency transmission lines in device 10 may be integrated into ceramic substrates, rigid printed circuit boards, and/or flexible printed circuits. In one suitable arrangement, radio-frequency transmission lines in device 10 may be integrated within multilayer laminated structures (e.g., layers of a conductive material such as copper and a dielectric material such as a resin that are laminated together without intervening adhesive) that may be folded or bent in multiple dimensions (e.g., two or three dimensions) and that maintain a bent or folded shape after bending (e.g., the multilayer laminated structures may be folded into a particular three-dimensional shape to route around other device components and may be rigid enough to hold its shape after folding without being held in place by stiffeners or other structures). All of the multiple layers of the laminated structures may be batch laminated together (e.g., in a single pressing process) without adhesive (e.g., as opposed to performing multiple pressing processes to laminate multiple layers together with adhesive).

Figure 4:
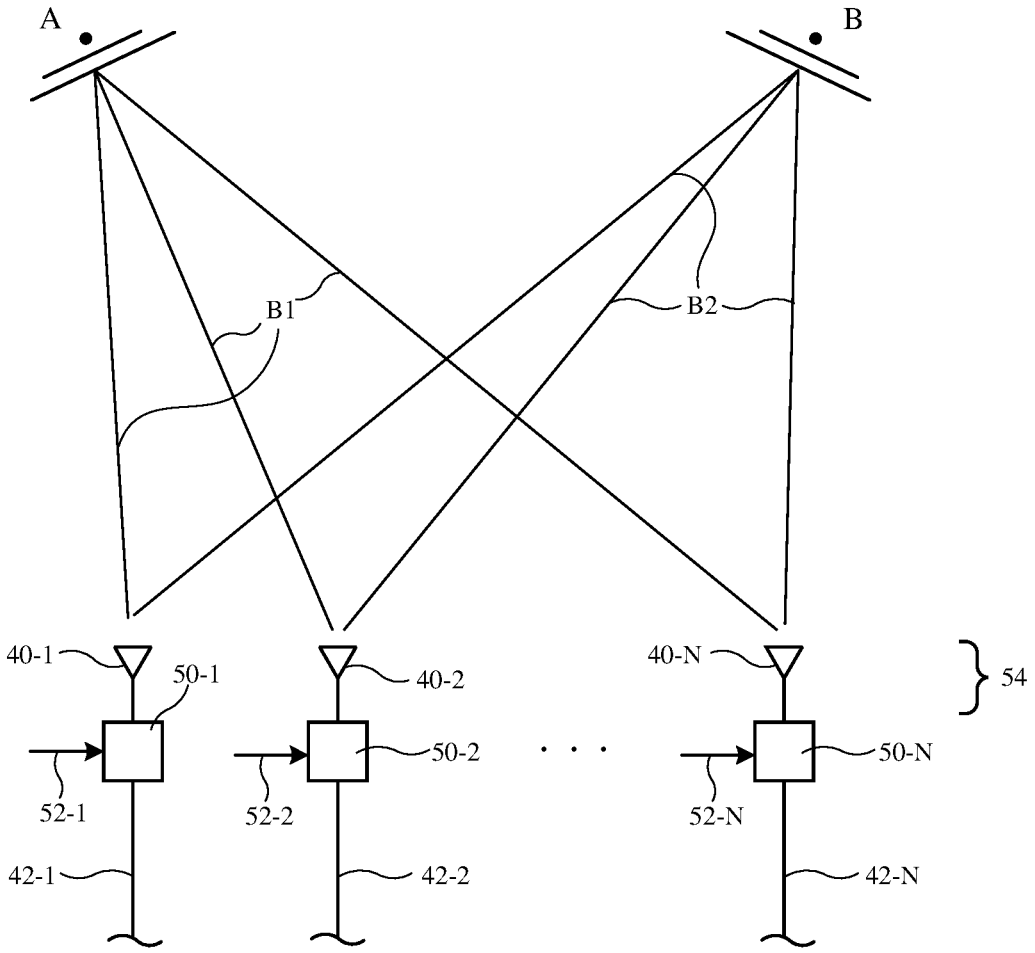
FIG. 4 is a diagram of an illustrative phased antenna array in accordance with some embodiments.

FIG. 4 shows how antennas 40 for handling radio-frequency signals at millimeter and centimeter wave frequencies may be formed in a phased antenna array. As shown in FIG. 4, phased antenna array 54 (sometimes referred to herein as array 54, antenna array 54, or array 54 of antennas 40) may be coupled to radio-frequency transmission lines 42. For example, a first antenna 40-1 in phased antenna array 54 may be coupled to a first radio-frequency transmission line 42-1, a second antenna 40-2 in phased antenna array 54 may be coupled to a second radio-frequency transmission line 42-2, an Nth antenna 40-N in phased antenna array 54 may be coupled to an Nth radio-frequency transmission line 42-N, etc. While antennas 40 are described herein as forming a phased antenna array, the antennas 40 in phased antenna array 54 may sometimes also be referred to as collectively forming a single phased array antenna.

Antennas 40 in phased antenna array 54 may be arranged in any desired number of rows and columns or in any other desired pattern (e.g., the antennas need not be arranged in a grid pattern having rows and columns). During signal transmission operations, radio-frequency transmission lines 42 may be used to supply signals (e.g., radio-frequency signals such as millimeter wave and/or centimeter wave signals) from millimeter/centimeter wave transceiver circuitry 38 (FIG. 3) to phased antenna array 54 for wireless transmission. During signal reception operations, radio-frequency transmission lines 42 may be used to supply signals received at phased antenna array 54 (e.g., from external wireless equipment or transmitted signals that have been reflected off of external objects) to millimeter/centimeter wave transceiver circuitry 38 (FIG. 3).

The use of multiple antennas 40 in phased antenna array 54 allows beam steering arrangements to be implemented by controlling the relative phases and magnitudes (amplitudes) of the radio-frequency signals conveyed by the antennas. In the example of FIG. 4, antennas 40 each have a corresponding radio-frequency phase and magnitude controller 50 (e.g., a first phase and magnitude controller 50-1 interposed on radio-frequency transmission line 42-1 may control phase and magnitude for radio-frequency signals handled by antenna 40-1, a second phase and magnitude controller 50-2 interposed on radio-frequency transmission line 42-2 may control phase and magnitude for radio-frequency signals handled by antenna 40-2, an Nth phase and magnitude controller 50-N interposed on radio-frequency transmission line 42-N may control phase and magnitude for radio-frequency signals handled by antenna 40-N, etc.).

Phase and magnitude controllers 50 may each include circuitry for adjusting the phase of the radio-frequency signals on radio-frequency transmission lines 42 (e.g., phase shifter circuits) and/or circuitry for adjusting the magnitude of the radio-frequency signals on radio-frequency transmission lines 42 (e.g., power amplifier and/or low noise amplifier circuits). Phase and magnitude controllers 50 may sometimes be referred to collectively herein as beam steering circuitry (e.g., beam steering circuitry that steers the beam of radio-frequency signals transmitted and/or received by phased antenna array 54).

Phase and magnitude controllers 50 may adjust the relative phases and/or magnitudes of the transmitted signals that are provided to each of the antennas in phased antenna array 54 and may adjust the relative phases and/or magnitudes of the received signals that are received by phased antenna array 54. Phase and magnitude controllers 50 may, if desired, include phase detection circuitry for detecting the phases of the received signals that are received by phased antenna array 54. The term "beam" or "signal beam" may be used herein to collectively refer to wireless signals that are transmitted and received by phased antenna array 54 in a particular direction. The signal beam may exhibit a peak gain that is oriented in a particular pointing direction at a corresponding pointing angle (e.g., based on constructive and destructive interference from the combination of signals from each antenna in the phased antenna array). The term "transmit beam" may sometimes be used herein to refer to radio-frequency signals that are transmitted in a particular direction whereas the term "receive beam" may sometimes be used herein to refer to radio-frequency signals that are received from a particular direction.

If, for example, phase and magnitude controllers 50 are adjusted to produce a first set of phases and/or magnitudes for transmitted radio-frequency signals, the transmitted signals will form a transmit beam as shown by beam B1 of FIG. 4 that is oriented in the direction of point A. If, however, phase and magnitude controllers 50 are adjusted to produce a second set of phases and/or magnitudes for the transmitted signals, the transmitted signals will form a transmit beam as shown by beam B2 that is oriented in the direction of point B. Similarly, if phase and magnitude controllers 50 are adjusted to produce the first set of phases and/or magnitudes, radio-frequency signals (e.g., radio-frequency signals in a receive beam) may be received from the direction of point A, as shown by beam B1. If phase and magnitude controllers 50 are adjusted to produce the second set of phases and/or magnitudes, radio-frequency signals may be received from the direction of point B, as shown by beam B2.

Each phase and magnitude controller 50 may be controlled to produce a desired phase and/or magnitude based on a corresponding control signal 52 received from control circuitry 28 of FIG. 2 (e.g., the phase and/or magnitude provided by phase and magnitude controller 50-1 may be controlled using control signal 52-1, the phase and/or magnitude provided by phase and magnitude controller 50-2 may be controlled using control signal 52-2, etc.). If desired, the control circuitry may actively adjust control signals 52 in real time to steer the transmit or receive beam in different desired directions over time. Phase and magnitude controllers 50 may provide information identifying the phase of received signals to control circuitry 28 if desired.

When performing wireless communications using radio-frequency signals at millimeter and centimeter wave frequencies, the radio-frequency signals are conveyed over a line of sight path between phased antenna array 54 and external communications equipment. If the external object is located at point A of FIG. 4, phase and magnitude controllers 50 may be adjusted to steer the signal beam towards point A (e.g., to steer the pointing direction of the signal beam towards point A). Phased antenna array 54 may transmit and receive radio-frequency signals in the direction of point A. Similarly, if the external communications equipment is located at point B, phase and magnitude controllers 50 may be adjusted to steer the signal beam towards point B (e.g., to steer the pointing direction of the signal beam towards point B). Phased antenna array 54 may transmit and receive radio-frequency signals in the direction of point B. In the example of FIG. 4, beam steering is shown as being performed over a single degree of freedom for the sake of simplicity (e.g., towards the left and right on the page of FIG. 4). However, in practice, the beam may be steered over two or more degrees of freedom (e.g., in three dimensions, into and out of the page and to the left and right on the page of FIG. 4). Phased antenna array 54 may have a corresponding field of view over which beam steering can be performed (e.g., in a hemisphere or a segment of a hemisphere over the phased antenna array). If desired, device 10 may include multiple phased antenna arrays that each face a different direction to provide coverage from multiple sides of the device.

Figure 5:
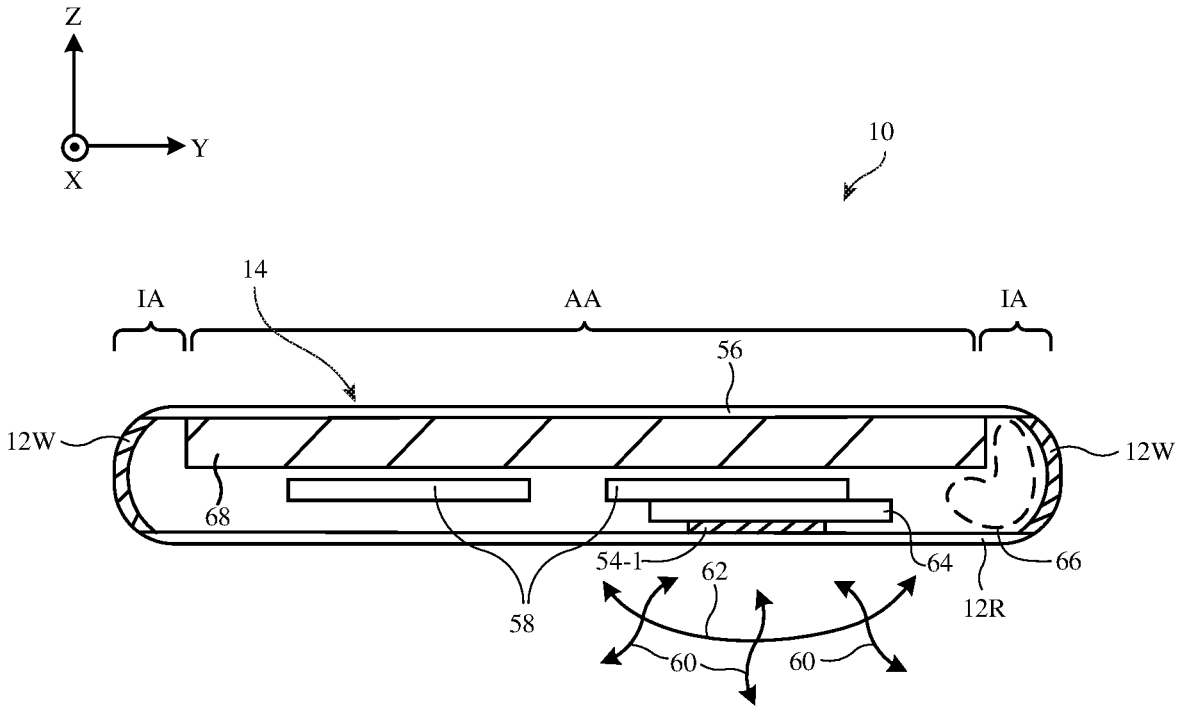
FIG. 5 is a cross-sectional side view of an illustrative electronic device having phased antenna arrays for radiating through different sides of the device in accordance with some embodiments.

FIG. 5 is a cross-sectional side view of device 10 in an example where device 10 has multiple phased antenna arrays. As shown in FIG. 5, peripheral conductive housing structures 12W may extend around the (lateral) periphery of device 10 and may extend from rear housing wall 12R to display 14. Display 14 may have a display module such as display module 68 (sometimes referred to as a display panel). Display module 68 may include pixel circuitry, touch sensor circuitry, force sensor circuitry, and/or any other desired circuitry for forming active area AA of display 14. Display 14 may include a dielectric cover layer such as display cover layer 56 that overlaps display module 68. Display module 68 may emit image light and may receive sensor input through display cover layer 56. Display cover layer 56 and display 14 may be mounted to peripheral conductive housing structures 12W. The lateral area of display 14 that does not overlap display module 68 may form inactive area IA of display 14.

Device 10 may include multiple phased antenna arrays 54 such as a rear-facing phased antenna array 54-1. As shown in FIG. 5, phased antenna array 54-1 may transmit and receive radio-frequency signals 60 at millimeter and centimeter wave frequencies through rear housing wall 12R. In scenarios where rear housing wall 12R includes metal portions, radio-frequency signals 60 may be conveyed through an aperture or opening in the metal portions of rear housing wall 12R or may be conveyed through other dielectric portions of rear housing wall 12R. The aperture may be overlapped by a dielectric cover layer or dielectric coating that extends across the lateral area of rear housing wall 12R (e.g., between peripheral conductive housing structures 12W). Phased antenna array 54-1 may perform beam steering for radio-frequency signals 60 across the hemisphere below device 10, as shown by arrow 62.

Phased antenna array 54-1 may be mounted to a substrate such as substrate 64. Substrate 64 may be an integrated circuit chip, a flexible printed circuit, a rigid printed circuit board, or other substrate. Substrate 64 may sometimes be referred to herein as antenna module 64. If desired, transceiver circuitry (e.g., millimeter/centimeter wave transceiver circuitry 38 of FIG. 2) may be mounted to antenna module 64. Phased antenna array 54-1 may be adhered to rear housing wall 12R using adhesive, may be pressed against (e.g., in contact with) rear housing wall 12R, or may be spaced apart from rear housing wall 12R.

The field of view of phased antenna array 54-1 is limited to the hemisphere under the rear face of device 10. Display module 68 and other components 58 (e.g., portions of input-output circuitry 24 or control circuitry 28 of FIG. 2, a battery for device 10, etc.) in device 10 include conductive structures. If care is not taken, these conductive structures may block radio-frequency signals from being conveyed by a phased antenna array within device 10 across the hemisphere over the front face of device 10 and/or across portions of hemispheres around the lateral edges of device 10 While an additional phased antenna array for covering the hemisphere over the front face of device 10 may be mounted against display cover layer 56 within inactive area IA, there may be insufficient space between the lateral periphery of display module 68 and peripheral conductive housing structures 12W to form all of the circuitry and radio-frequency transmission lines necessary to fully support the phased antenna array. The presence of peripheral conductive housing structures 12W may also prevent a front-facing phased antenna array from providing adequate coverage around the lateral periphery of device 10.

In order to help mitigate these issues, a side-facing phased antenna array may be mounted within peripheral region 66. The side-facing phased antenna array may radiate through one or more apertures in peripheral conductive housing structures 12W (e.g., through the side of device 10). Additionally or alternatively, a front-facing phased antenna array may be mounted within peripheral region 66 of device 10 for radiating through display cover layer 56. In one suitable arrangement that is described herein as an example, the antennas in the side-facing phased antenna array may include dielectric resonator antennas. Dielectric resonator antennas may occupy less area than other types of antennas such as patch antennas and slot antennas. Implementing the antennas as dielectric resonator antennas may allow the radiating elements of the side-facing phased antenna array to fit within inactive area IA between display module 68 and peripheral conductive housing structures 12W. At the same time, the radio-frequency transmission lines and other components for the phased antenna array may be located behind (under) display module 68.

Figure 6:
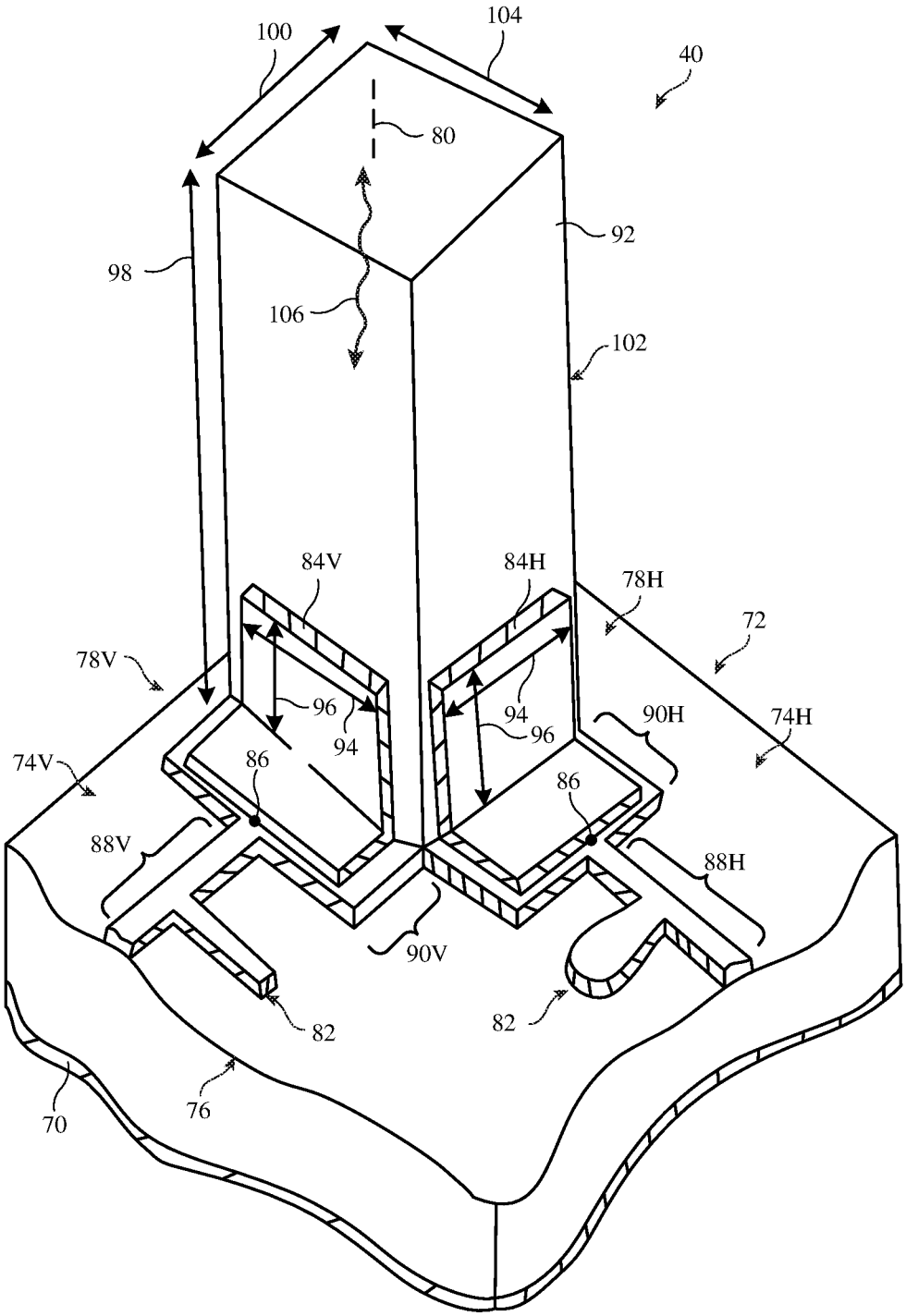
FIG. 6 is a perspective view of an illustrative dielectric resonator antenna in accordance with some embodiments.

FIG. 6 is a perspective view of an illustrative dielectric resonator antenna that may be formed in a side-facing phased antenna array of device 10. As shown in FIG. 6, antenna 40 may include a dielectric resonating element such as dielectric resonating element 92. Dielectric resonating element 92 may be mounted to an underlying substrate such as printed circuit 72. Printed circuit 72 may be a flexible printed circuit or a rigid printed circuit board (PCB). Printed circuit 72 may include one or more stacked dielectric layers. The stacked dielectric layers may include polyimide, ceramic, liquid crystal polymer, plastic, and/or any other desired materials. Conductive traces may be patterned onto one or more of the stacked dielectric layers. This example is merely illustrative and, if desired, printed circuit 72 may be replaced with a plastic substrate or any other desired substrate.

As shown in FIG. 6, conductive traces such as conductive traces 70 may be patterned onto the bottom surface of printed circuit 72. Conductive traces 70 may be held at a ground potential and may therefore sometimes be referred to herein as ground traces 70. Ground traces 70 may be shorted to additional ground traces within printed circuit 72 and/or on the opposing surface 76 of printed circuit 72 (e.g., using conducive vias that extend through printed circuit 72). Ground traces 70 may form part of the antenna ground for antenna 40. Ground traces 70 may be coupled to a system ground in device 10 (e.g., using solder, welds, conductive adhesive, conductive tape, conductive brackets, conductive pins, conductive screws, conductive clips, combinations of these, etc.). For example, ground traces 70 may be coupled to peripheral conductive housing structures 12W (FIG. 5), conductive portions of rear housing wall 12R, or other grounded structures in device 10.

Antenna 40 may be fed using one or more radio-frequency transmission lines that are formed on and/or embedded within printed circuit 72. In the example of FIG. 6, antenna 40 is a dual-polarization antenna having a first radio-frequency transmission line 74V and a second radio-frequency transmission line 74H. The signal conductor of radio-frequency transmission line 74V (e.g., signal conductor 46 of FIG. 3) may be formed from conductive traces 88V and 90V patterned onto surface 76 of substrate 72. The signal conductor of radio-frequency transmission line 74H may be formed from conductive traces 88H and 90H patterned onto surface 76 of substrate 72. Conductive trace 88V may be narrower than conductive trace 90V. Conductive trace 88H may be narrower than conductive trace 90H. Conductive traces 90V and 90H may, for example, be conductive contact pads on surface 76 of printed circuit 72.

If desired, conductive traces 88V and/or 88H may include one or more impedance matching structures such as transmission line stubs 82. Transmission line stubs 82 may have any desired shape or may be omitted. The impedance matching structures may help to match the impedance of the radio-frequency transmission lines to the impedance of antenna 40. Conductive traces 88V, 90V, 88H, and 90H may have other shapes (e.g., shapes having any desired number of straight and/or curved edges).

Dielectric resonating element 92 of antenna 40 may be formed from a column (pillar) of dielectric material mounted or otherwise coupled to surface 76 of printed circuit 72. If desired, dielectric resonating element 92 may be embedded within (e.g., laterally surrounded by) a dielectric substrate mounted to surface 76 of printed circuit 72 (not shown in FIG. 6 for the sake of clarity). The operating (resonant) frequency of antenna 40 may be selected by adjusting the dimensions of dielectric resonating element 92.

Dielectric resonating element 92 may be formed from a column of dielectric material having a first dielectric constant $d_{k1}$. Dielectric constant $d_{k1}$ may be relatively high (e.g., greater than 10.0, greater than 12.0, greater than 15.0, greater than 20.0, between 15.0 and 40.0, between 10.0 and 50.0, between 18.0 and 30.0, between 12.0 and 45.0, etc.). In one suitable arrangement, dielectric resonating element 92 may be formed from zirconia or a ceramic material. Other dielectric materials may be used to form dielectric resonating element 92 if desired. The dielectric substrate surrounding dielectric resonating element 92 may have a dielectric constant that differs from the dielectric constant of dielectric resonating element 92 by at least a predetermined margin. The difference in dielectric constant between dielectric resonating element 92 and the surrounding dielectric substrate may establish a strong radio-frequency boundary condition that configures dielectric resonating element 92 to serve as a waveguide for propagating radio-frequency signals at millimeter and centimeter wave frequencies.

Dielectric resonating element 92 may radiate radio-frequency signals 106 when excited by the signal conductor for radio-frequency transmission lines 74V or 74H. Antenna 40 may be fed using one or more radio-frequency feed probes such as feed probes 78V and 78H. Feed probes 78V and 78H may form part of the antenna feed for antenna 40 (e.g., antenna feed 44 of FIG. 3).

As shown in FIG. 6, feed probe 78V may include feed conductor 84V. Feed probe 78H may include feed conductor 84H. In one suitable arrangement that is described herein as an example, feed conductors 84V and 84H may be formed from stamped sheet metal that has been folded into a desired shape and that is press against sidewalls 102 of dielectric resonating element 92. If desired, biasing structures (not shown in FIG. 6 for the sake of clarity) may hold or press feed conductors 84V and 84H against sidewalls 102 to help ensure a reliable coupling between the feed conductors and the dielectric resonating element. In another suitable arrangement, feed conductors 84V and 84H may be formed from conductive traces that are patterned directly onto sidewalls 102 (e.g., using a laser direct structuring (LDS) process, a sputtering process, or other conductive metallization techniques).

Feed conductor 84V may have a first portion on a first sidewall 102 of dielectric resonating element 92. Feed conductor 84V may have a second portion coupled to conductive traces 90V using conductive interconnect structures 86. Conductive interconnect structures 86 may include solder, conductive pins (e.g., pogo pins), welds, conductive adhesive, conductive tape, conductive foam, conductive springs, conductive brackets, conductive traces, and/or any other desired conductive interconnect structures. Similarly, feed conductor 84H may have a first portion on a second sidewall 102 of dielectric resonating element 92. Feed conductor 84H may have a second portion coupled to conductive traces 90H using conductive interconnect structures 86.

Radio-frequency transmission line 74V may convey radio-frequency signals to and from feed probe 78V. Radio-frequency transmission line 74H may convey radio-frequency signals to and from feed probe 78H. Feed probes 78V and 78H may electromagnetically couple the radio-frequency signals into dielectric resonating element 92. This may serve to excite one or more electromagnetic modes (e.g., radio-frequency cavity or waveguide modes) of dielectric resonating element 92. When excited by feed probe 78V and/or feed probe 78H, the electromagnetic modes of dielectric resonating element 92 may configure the dielectric resonating element to serve as a waveguide that propagates the wavefronts of radio-frequency signals 106 along the length of dielectric resonating element 92 and through the top surface of dielectric resonating element 92 (e.g., in the direction of the central/longitudinal axis 80 of dielectric resonating element 92).

For example, during signal transmission, radio-frequency transmission lines 74H and 74V may supply radio-frequency signals from the millimeter/centimeter wave transceiver circuitry to antenna 40. Feed probes 78V and 78H may couple the radio-frequency signals into dielectric resonating element 92. This may serve to excite one or more electromagnetic modes of dielectric resonating element 92, resulting in the propagation of radio-frequency signals 106 up the length of dielectric resonating element 92. Similarly, during signal reception, radio-frequency signals 106 may be received by dielectric resonating element 92. The received radio-frequency signals may excite the electromagnetic modes of dielectric resonating element 92, resulting in the propagation of the radio-frequency signals down the length of dielectric resonating element 92. Feed probes 78V and 78H may couple the received radio-frequency signals onto radio-frequency transmission lines 74V and 74H, which pass the radio-frequency signals to the millimeter/centimeter wave transceiver circuitry.

If desired, the dimensions of feed probes 78V and 78H may be selected to help match the impedance of radio-frequency transmission lines 74V and 74H to the impedance of dielectric resonating element 92. For example, feed conductors 84V and 84H may each have width 94 and height 96. Width 94 and height 96 may be selected to match the impedance of radio-frequency transmission lines 74V and 74H to the impedance of dielectric resonating element 92. As examples, width 94 may be between 0.3 mm and 0.7 mm, between 0.2 mm and 0.8 mm, between 0.4 mm and 0.6 mm, or other values. Height 96 may be between 0.3 mm and 0.7 mm, between 0.2 mm and 0.8 mm, between 0.4 mm and 0.6 mm, or other values. Height 96 may be equal to width 94 or may be different than width 94.

Feed probes 78V and 78H may be coupled to orthogonal sidewalls 102 of dielectric resonating element 92. Feeding antenna 40 using both feed probes 78V and 78H may configure antenna 40 to cover multiple orthogonal linear polarizations at once. The phase of each feed probe may be independently adjusted over time to provide the antenna with other polarizations such as an elliptical or circular polarization if desired. Feed probes 78V and 78H may sometimes be referred to herein as feed conductors, feed patches, or probe feeds. Dielectric resonating element 92 may sometimes be referred to herein as a dielectric radiating element, dielectric radiator, dielectric resonator, dielectric antenna resonating element, dielectric column, dielectric pillar, radiating element, or resonating element. When fed by one or more feed probes such as feed probes 78V and 78H, dielectric resonator antennas such as antenna 40 of FIG. 6 may sometimes be referred to herein as probe-fed dielectric resonator antennas.

Radio-frequency transmission line 74V and feed probe 78V may convey first radio-frequency signals having a first linear polarization (e.g., a vertical polarization). When driven using the first radio-frequency signals, feed probe 78V may excite one or more electromagnetic modes of dielectric resonating element 92 associated with the first polarization. When excited in this way, wave fronts associated with the first radio-frequency signals may propagate along the length of dielectric resonating element 92 (e.g., along central/longitudinal axis 80) and may be radiated into free space. Similarly, radio-frequency transmission line 74H and feed probe 78H may convey radio-frequency signals of a second linear polarization orthogonal to the first polarization (e.g., a horizontal polarization). When driven using the second radio-frequency signals, feed probe 78H may excite one or more electromagnetic modes of dielectric resonating element 92 associated with the second polarization. When excited in this way, wave fronts associated with the second radio-frequency signals may propagate along the length of dielectric resonating element 92 and may be radiated into free space. Both feed probes 78H and 78V may be active at once so that antenna 40 conveys both the first and second radio-frequency signals at any given time. In another suitable arrangement, a single one of feed probes 78H and 78V may be active at once so that antenna 40 conveys radio-frequency signals of only a single polarization at any given time.

Dielectric resonating element 92 may have a length 100, a width 104 (e.g., measured orthogonal to length 100), and a height 98 (e.g., measured parallel to central/longitudinal axis 80 and orthogonal to length 100 and width 104). Length 100, width 104, and height 98 may be selected to provide dielectric resonating element 92 with a corresponding mix of electromagnetic cavity/waveguide modes that, when excited by feed probes 78H and/or 78V, configure antenna 40 to radiate at desired frequencies. For example, height 98 may be 2-10 mm, 4-6 mm, 3-7 mm, 4.5-5.5 mm, or greater than 2 mm. Width 104 and length 100 may each be 0.5-1.0 mm, 0.4-1.2 mm, 0.7-0.9 mm, 0.5-2.0 mm, 1.5 mm-2.5 mm, 1.7 mm-1.9 mm, 1.0 mm-3.0 mm, etc. Width 104 may be equal to length 100 or, in other arrangements, may be different than length 100. Sidewalls 102 of dielectric resonating element 92 may contact the surrounding dielectric substrate (not shown in FIG. 6 for the sake of clarity).

The example of FIG. 6 is merely illustrative. Dielectric resonating element 92 may have other shapes (e.g., shapes having any desired number of curved and/or straight edges or surfaces). Antenna 40 need not be a dual-polarization antenna and may, if desired, be a single-polarization antenna. In arrangements where antenna 40 is a single-polarization antenna, feed probe 78H and conductive traces 90H and 88H may be omitted. If desired, one or more optional parasitic patches may be coupled to one or more sidewalls 102 of dielectric resonating element 92.

In one suitable arrangement that is described herein as an example, antenna 40 of FIG. 6 may form a part of a side-facing phased antenna array that radiates through one or more apertures in peripheral conductive housing structures 12W (FIG. 5). This is merely illustrative and, in other arrangements, antenna 40 may not be a part of any phased antenna array. In some scenarios, antennas such as antenna 40 are formed within an integrated antenna module along with each other antenna in a corresponding phased antenna array. A dielectric substrate is molded around each of the dielectric resonating elements in the phased antenna array on the antenna module. The antenna module is then mounted within device 10. However, forming the phased antenna array within an integrated antenna module that is mounted into device 10 may undesirably increase the cost and manufacturing complexity of device 10 and can undesirably limit mechanical reliability. In order to mitigate these issues, antenna 40 of FIG. 6 may be integrated directly into the housing of device 10 (e.g., housing 12 of FIG. 1).

Figure 7:
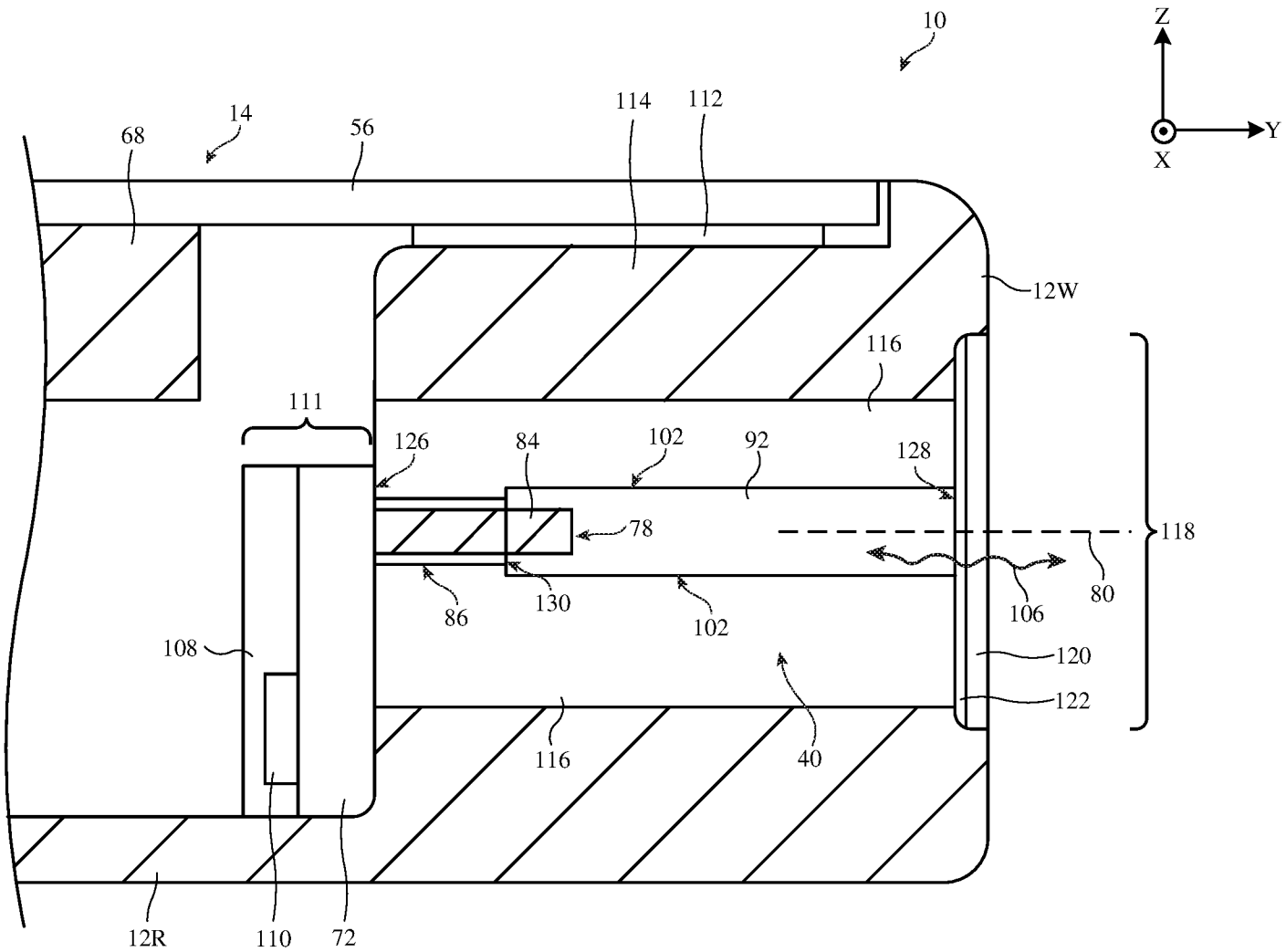
FIG. 7 is a cross-sectional side view showing how an illustrative rear-fed dielectric resonator antenna may be integrated within conductive housing structures of an electronic device in accordance with some embodiments.

FIG. 7 is a cross-sectional side view showing one example of how antenna 40 may be integrated directly into the housing of device 10. As shown in FIG. 7, antenna 40 may be a side-facing antenna that is aligned with an aperture such as aperture 118 in peripheral conductive housing structures 12W. Antenna 40 of FIG. 7 may form a part of a larger phased antenna array (e.g., a one-dimensional phased antenna array having multiple antennas 40 for radiating through peripheral conductive housing structures 12W). Each antenna in the phased antenna array may radiate through the same aperture 118 or may radiate through multiple apertures 118 (e.g., respective apertures for each antenna in the phased antenna array).

As shown in FIG. 7, dielectric resonating element 92 may be oriented such that central/longitudinal axis 80 lies within a plane parallel to the front/rear faces of device 10 (e.g., central/longitudinal axis 80 may lie within a plane parallel to the X-Y plane of FIG. 7). Dielectric resonating element 92 may be aligned with aperture 118. Aperture 118 (sometimes referred to herein as slot 118 or antenna window 118) may allow antenna 40 to convey radio-frequency signals 106 through peripheral conductive housing structures 12W. A dielectric cover layer such as dielectric cover layer 120 (e.g., a cosmetic window) may overlap and fill aperture 118 to protect antenna 40 and the interior of device 10 from damage or contaminants. If desired, a layer of adhesive such as adhesive 122 may help to adhere dielectric cover layer 120 to peripheral conductive housing structures 12W. Adhesive 122 may also adhere surface 128 of dielectric resonating element 92 to dielectric cover layer 120 if desired.

Dielectric resonating element 92 may have a surface 130 that opposes surface 128. Sidewalls 102 of dielectric resonating element 92 may extend from surface 130 to surface 128 (e.g., along central/longitudinal axis 80). Feed conductor 84 (e.g., feed conductor 84V or 84H of FIG. 6) of feed probe 78 (e.g., feed probe 78V or 78H of FIG. 6) may be coupled to a given sidewall 102 of dielectric resonating element 92 at or adjacent to surface 130. Conductive interconnect structures 86 may couple feed probe 78 to printed circuit 72. The lateral area of printed circuit 72 may extend parallel to the X-Z plane of FIG. 7 in this example. If desired, each of the antennas in the side-facing phased antenna array may be coupled to and fed by the same printed circuit 72. If desired, a radio-frequency integrated circuit (RFIC) such as RFIC 110 may be mounted to printed circuit 72. RFIC 110 may be encapsulated within overmold 108, thereby forming a corresponding antenna module 111 that includes RFIC 110, overmold 108, and printed circuit 72. RFIC 110 may include upconversion and downconversion circuitry and phase and magnitude controllers (e.g., phase and magnitude controllers 50 of FIG. 4) for each of the antennas in the side-facing phased antenna array, for example. Antenna module 111 may rest against rear housing wall 12R if desired.

Peripheral conductive housing structures 12W may include a ledge structure such as ledge 114 (sometimes referred to herein as datum 114). Display 14 may be mounted to ledge 114 of peripheral conductive housing structures 12W. If desired, a layer of adhesive such as adhesive 112 may be used to adhere display cover layer 56 to ledge 114. Antenna 40 may be vertically interposed between ledge 114 and rear housing wall 12R.

Dielectric resonating element 92 may be embedded within dielectric substrate 116. Dielectric substrate 116 may surround each sidewall 102 of dielectric resonating element 92. Dielectric substrate 116 may, for example, be an injection-molded plastic substrate that serves to affix dielectric resonating element 92 to peripheral conductive housing structures 12W, thereby integrating dielectric resonating element 92 and thus antenna 40 directly into the housing of device 10. Dielectric substrate 116 may cover an entirety of dielectric resonating element 92 except for surface 128 and portions of surface 130 that are not covered by conductive interconnect structures 86, for example. Dielectric substrate 116 may extend from a first surface 126 to aperture 118 (e.g., dielectric substrate 116 may have a second surface opposite first surface 126 that lies flush with surface 128 of dielectric resonating element 92). Printed circuit 72 may be mounted to surface 126 of dielectric substrate 116. Dielectric substrate 116 may be molded over feed probe 78 and/or may include openings, notches, or other structures that help to accommodate the presence of feed probe 78.

Dielectric substrate 116 may be formed from a material having dielectric constant $d_{k2}$. Dielectric constant $d_{k2}$ may be less than the dielectric constant $d_{k1}$ of dielectric resonating element 92 (e.g., less than 18.0, less than 15.0, less than 10.0, between 3.0 and 4.0, less than 5.0, between 2.0 and 5.0, etc.). Dielectric constant $d_{k2}$ may be less than dielectric constant $d_{k1}$ by at least 10.0, 5.0, 15.0, 12.0, 6.0, etc. The difference in dielectric constant between dielectric resonating element 92 and dielectric substrate 116 may establish a strong radio-frequency boundary condition between dielectric resonating element 92 and dielectric substrate 116 from surface 130 to surface 128. This may configure dielectric resonating element 92 to serve as a waveguide for propagating radio-frequency signals at millimeter and centimeter wave frequencies. If desired, the width of dielectric substrate 116 (e.g., measured parallel to the Z-axis of FIG. 7) may be selected to isolate dielectric resonating element 92 from peripheral conductive housing structures 12W and to minimize signal reflections in dielectric substrate 116.

The relatively large difference in dielectric constant between dielectric resonating element 92 and dielectric substrate 116 may allow dielectric resonating element 92 to convey radio-frequency signals 106 through dielectric cover layer 120 and aperture 118 with a relatively high antenna efficiency (e.g., by establishing a strong boundary between dielectric resonating element 92 and dielectric substrate 116 for the radio-frequency signals). The relatively high dielectric constant of dielectric resonating element 92 may also allow the dielectric resonating element 92 to occupy a relatively small volume compared to scenarios where materials with a lower dielectric constant are used.

Antenna 40 may be integrated into peripheral conductive housing structures 12W using any desired manufacturing methods. Device 10 may be assembled using manufacturing equipment. In one suitable arrangement, the manufacturing equipment may perform a two-stage molding operation to integrate antenna 40 into device 10. In the two-stage molding operation, the manufacturing equipment may first produce feed probe 78 (e.g., from stamped sheet metal). The manufacturing equipment may then press and hold feed probe 78 against dielectric resonating element 92 (e.g., using biasing structures, retention elements, or other equipment). The manufacturing equipment may then perform a first injection molding operation in which a portion of dielectric substrate 116 (e.g., a first shot of injection-molded plastic) is injection molded over feed probe 78 to ensure that feed probe 78 is held in place during further assembly.

The manufacturing equipment may then hold dielectric resonating element 92 and the molded feed probe 78 in place within a cavity in peripheral conductive housing structures 12W (e.g., where the cavity is vertically interposed between ledge 114 and rear housing wall 12R and is aligned with aperture 118). The manufacturing equipment may hold these components in place from the interior of device 10 or from the exterior of device 10 (e.g., through aperture 118 prior to deposition of adhesive 122 or dielectric cover layer 120). While these components are being held in place, the manufacturing equipment may perform a second injection molding operation in which the remainder of dielectric substrate 116 (e.g., a second shot of injection-molded plastic) is injection molded into the cavity and over the remainder of dielectric resonating element 92. The second injection molding operation may lock dielectric resonating element 92 into place within the cavity, thereby integrating antenna 40 into peripheral conductive housing structures 12W.

After dielectric substrate 116 has been injection-molded into peripheral conductive housing structures 12W, the manufacturing equipment may drill or mill a hole in dielectric substrate 116 to accommodate conductive interconnect structures 86. The manufacturing equipment may then couple conductive interconnect structures 86 to feed probe 78 through the hole in dielectric substrate 116. This is merely illustrative and, in general, any desired machining operation may be used to expose feed probe 78 through dielectric substrate 116. Once conductive interconnect structures 86 are in place, the manufacturing equipment may mount antenna module 111 (e.g., printed circuit 72) to conductive interconnect structures 86 (e.g., using low temperature solder). As an example, conductive interconnect structures 86 may include conductive pins that couple contact pads on printed circuit 72 (e.g., conductive traces 90V and 90H of FIG. 6) to feed probe 78 through milled or drilled holes in dielectric substrate 116 or that are otherwise coupled to feed probe 78 as exposed through dielectric substrate 116.

This process may be performed for each antenna in the side-facing phased antenna array in sequence or in parallel. Each antenna in the side-facing phased antenna array may be embedded within a respective dielectric substrate 116 if desired. Each antenna in the side-facing phased antenna array may convey radio-frequency signals within the same frequency band or, if desired, the side-facing phased antenna array may include at least first and second sets of antennas for covering at least first and second frequency bands. The first and second sets of antennas may be arranged in an interleaved pattern across the side-facing phased antenna array.

This example is merely illustrative. In general, other manufacturing and assembly methods may be used to integrate antenna 40 within peripheral conductive housing structures 12W. In another suitable arrangement, feed probe 78 may be formed from conductive traces that are patterned directly onto dielectric resonating element 92. In this arrangement, antenna 40 may be embedded within peripheral conductive housing structures 12W using only a single injection molding operation if desired (e.g., using only a single shot of injection-molded plastic). While only a single feed probe 78 is shown in FIG. 7 for the sake of clarity, antenna 40 may include multiple feed probes if desired (e.g., feed probes 78V and 78H of FIG. 6).

Figure 8:
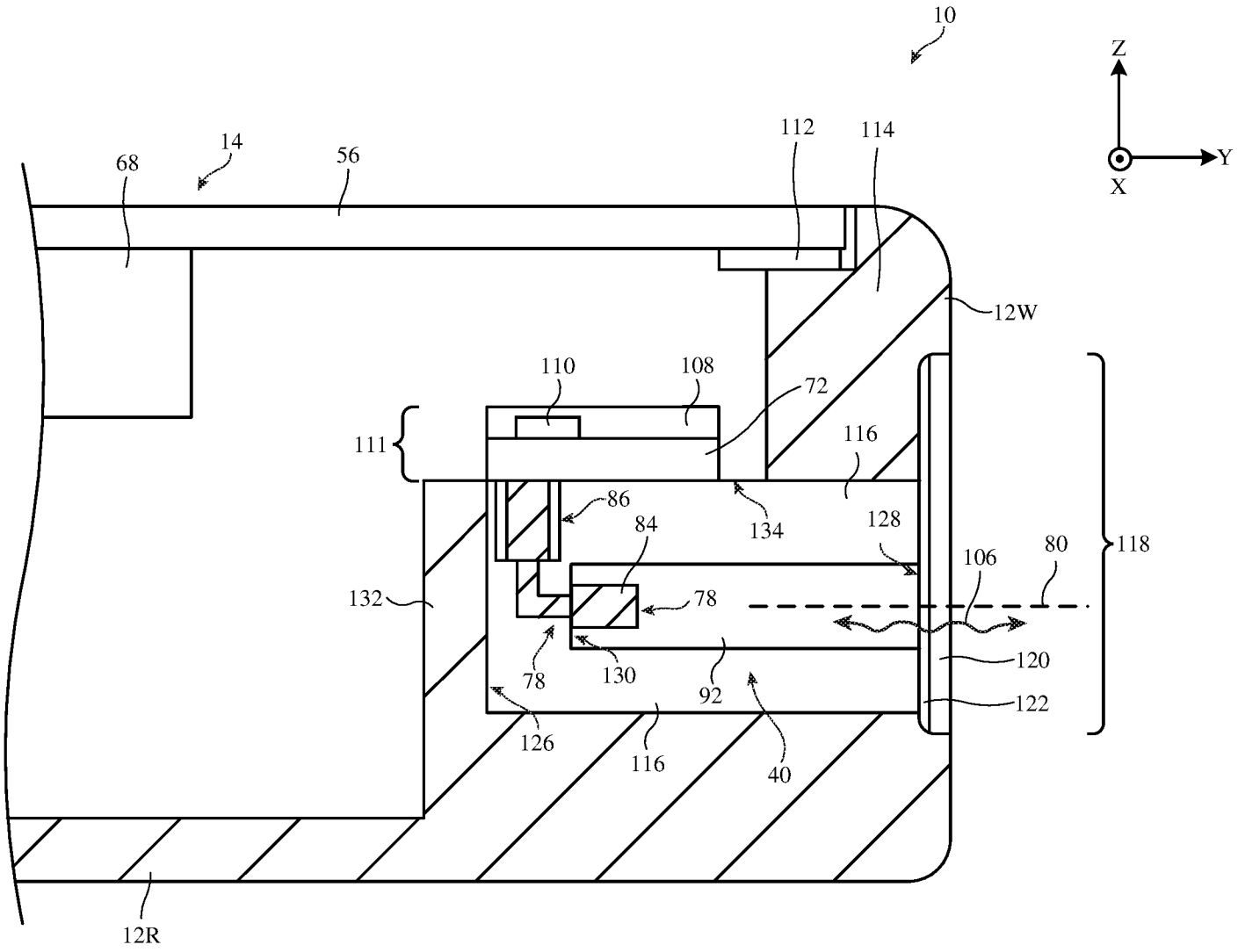
FIG. 8 is a cross-sectional side view showing how an illustrative side-fed dielectric resonator antenna may be integrated within conductive housing structures of an electronic device in accordance with some embodiments.

In the example of FIG. 7, antenna 40 is a rear-fed dielectric resonator antenna because printed circuit 72, which feeds antenna 40, is coupled to the rear surface of dielectric substrate 116 and dielectric resonating element 92 (e.g., surfaces 126 and 130). In another suitable arrangement, antenna 40 may be a side-fed dielectric resonator antenna in which printed circuit 72 is coupled to a side surface of dielectric substrate 116 and dielectric resonating element 92. FIG. 8 is a cross-sectional side view showing how antenna 40 may be a side-fed dielectric resonator antenna integrated (molded) into peripheral conductive housing structures 12W.

As shown in FIG. 8, dielectric substrate 116 may have a side surface such as surface 134. Surface 134 may contact the bottom side of ledge 114 of peripheral conductive housing structures 12W. Surface 134 may extend from surface 126 to aperture 118. Printed circuit 72 of antenna module 111 may be mounted to surface 134 of dielectric substrate 116. Conductive interconnect structures 86 may be placed within a hole in dielectric substrate 116 and may couple printed circuit 72 to feed probe 78. This is merely illustrative and, in general, any desired machining operation may be used to expose feed probe 78 through dielectric substrate 116 for conductive interconnect structures 86. Printed circuit 72 may rest on surface 134 of dielectric substrate 116. The lateral area of printed circuit 72 may extend parallel to the X-Y plane of FIG. 8. If desired, the housing of device 10 may include an optional retention member 132 that extends from rear housing wall 12R towards display cover layer 56. Retention member 132 may be formed from an integral portion of rear housing wall 12R or from a conductive frame for device 10, as examples. Retention member 132 may be formed from conductive material or from dielectric. Retention member 132 may help to hold dielectric substrate 116 and antenna 40 in place during and/or after the injection molding process. The same injection molding processes as described in connection with FIG. 7 may be used to embed antenna 40 of FIG. 8 within peripheral conductive housing structures 12W. Side-feeding antenna 40 in this way may, if desired, allow dielectric resonating element 92 to be shorter (e.g., in the direction of central/longitudinal axis 80) than in arrangements where antenna 40 is rear-fed.

Integrating antenna 40 into peripheral conductive housing structures 12W as shown in FIGS. 7 and 8 may allow antenna 40 to convey radio-frequency signals 106 through peripheral conductive housing structures 12W (e.g., to provide millimeter/centimeter wave coverage around the lateral periphery of device 10), may simplify the manufacturing process for the side-facing phased antenna array, may reduce manufacturing cost for the side-facing phased antenna array, may maximize reliability and performance antenna 40, and/or may increase the stiffness and structural integrity of the housing for device 10, as examples. The example of FIGS. 7 and 8 in which antenna 40 is a side-facing antenna is merely illustrative. In general, antenna 40 may be integrated into peripheral conductive housing structures 12W and/or rear housing wall 12R for radiating through the front face of device 10 (e.g., through display cover layer 56 by orienting central/longitudinal axis 80 of dielectric resonating element 92 parallel to the Z-axis of FIGS. 7 and 8) or through the rear face of device 10 (e.g., through a dielectric portion of rear housing wall 12R by orienting central/longitudinal axis 80 parallel to the Z-axis of FIGS. 7 and 8).

Device 10 may gather and/or use personally identifiable information. It is well understood that the use of personally identifiable information should follow privacy policies and practices that are generally recognized as meeting or exceeding industry or governmental requirements for maintaining the privacy of users. In particular, personally identifiable information data should be managed and handled so as to minimize risks of unintentional or unauthorized access or use, and the nature of authorized use should be clearly indicated to users.

The foregoing is merely illustrative and various modifications can be made by those skilled in the art without departing from the scope and spirit of the described embodiments. The foregoing embodiments may be implemented individually or in any combination.

What is claimed is:

1. An electronic device comprising:
a conductive housing wall;
an aperture in the conductive housing wall;
a dielectric resonating element aligned with the aperture and configured to convey radio-frequency signals at a frequency greater than 10 GHz through the aperture; and
an injection-molded plastic substrate, wherein the dielectric resonating element is embedded in the injection-molded plastic substrate and the injection-molded plastic substrate affixes the dielectric resonating element to the conductive housing wall.

2. The electronic device of claim 1, wherein the conductive housing wall comprises a cavity and the injection-molded plastic substrate affixes the dielectric resonating element to the conductive housing wall within the cavity.

3. The electronic device of claim 2, further comprising:
peripheral conductive housing structures that extend around a periphery of the electronic device and that include the conductive housing wall;
a display mounted to the peripheral conductive housing structures; and
a rear housing wall mounted to the peripheral conductive housing structures opposite the display.

4. The electronic device of claim 3, further comprising:
a dielectric cover layer that covers the aperture; and
a layer of adhesive that adheres the dielectric cover layer to the conductive housing wall, the dielectric resonating element, and the injection-molded plastic substrate.

5. The electronic device of claim 4, further comprising:
a feed probe coupled to the dielectric resonating element and configured to excite the dielectric resonating element, wherein the feed probe is embedded in the injection-molded plastic substrate.

6. The electronic device of claim 5, further comprising:
a printed circuit;
a hole in the injection-molded plastic substrate; and
a conductive interconnect structure in the hole, wherein the conductive interconnect structure couples the printed circuit to the feed probe.

7. The electronic device of claim 6, wherein the feed probe comprises stamped sheet metal.

8. The electronic device of claim 5, wherein the feed probe comprises a conductive trace patterned on the dielectric resonating element.

9. The electronic device of claim 5, wherein the injection-molded plastic substrate comprises a first shot of injection-molded plastic over the feed probe and a second shot of injection-molded plastic that affixes the dielectric resonating element to the conductive housing wall.

10. The electronic device of claim 1, further comprising:
a feed probe coupled to the dielectric resonating element and configured to excite the dielectric resonating element, wherein the feed probe is embedded in the injection-molded plastic substrate;
a printed circuit; and
a conductive interconnect structure that couples the printed circuit to the feed probe, wherein the dielectric resonating element extends along a longitudinal axis from a first surface to a second surface at the aperture, the injection-molded plastic substrate has a third surface that lies flush with the second surface of the dielectric resonating element, the injection-molded plastic substrate has a fourth surface opposite the third surface, and the injection-molded plastic substrate has a fifth surface that extends from the third surface to the fourth surface.

11. The electronic device of claim 10, wherein the printed circuit is mounted to the fifth surface of the injection-molded plastic substrate.

12. An electronic device comprising:
peripheral conductive housing structures that run around a periphery of the electronic device;
a display mounted to the peripheral conductive housing structures;
a rear housing wall mounted to the peripheral conductive housing structures opposite the display;
an aperture in the peripheral conductive housing structures; and
a dielectric resonator antenna aligned with the aperture and configured to radiate at a frequency greater than 10 GHz through the aperture.

13. The electronic device of claim 12, wherein the dielectric resonator antenna comprises an injection-molded plastic substrate, a dielectric column embedded in the injection-molded plastic substrate, and a feed probe on the dielectric column and embedded in the injection-molded plastic substrate.

14. The electronic device of claim 13, further comprising:
a hole in the injection-molded plastic substrate;
a printed circuit mounted to the injection molded plastic substrate; and
a conductive interconnect structure in the hole, wherein the conductive interconnect structure couples the printed circuit to the feed probe and is soldered to the printed circuit.

15. The electronic device of claim 14, wherein the injection-molded plastic substrate comprises a first shot of injection molded plastic over the feed probe and a second shot of injection molded plastic over the first shot of injection molded plastic and the dielectric column.

16. The electronic device of claim 14, wherein the conductive interconnect structure comprises a conductive pin.

17. An electronic device comprising:
a housing having a rear wall and a conductive sidewall;
a display having a display cover layer mounted to the conductive sidewall opposite the rear wall;
an antenna window in the conductive sidewall;

a dielectric resonating element aligned with the antenna window;

a feed probe coupled to the dielectric resonating element and configured to excite the dielectric resonating element to radiate through the antenna window at a frequency greater than 10 GHz; and a printed circuit coupled to the feed probe and interposed between the dielectric resonating element and the display cover layer.

18. The electronic device of claim 17, further comprising:

an injection-molded plastic substrate, wherein the dielectric resonating element and the feed probe are embedded in the injection-molded plastic substrate and the printed circuit is coupled to the feed probe through the injection-molded plastic substrate.

19. The electronic device of claim 18, wherein the housing comprises a retention member that extends from the rear wall and contacts the injection-molded plastic substrate, the dielectric resonating element being interposed between the retention member and the antenna window.

20. The electronic device of claim 17, wherein the dielectric resonating element comprises ceramic extending from a first end to an opposing second end at the antenna window, the dielectric resonating element has a sidewall extending from the first end to the second end, and the feed probe is pressed against the sidewall of the dielectric resonating element.

* * * * *